US008462056B2

(12) United States Patent
Byun et al.

(10) Patent No.: US 8,462,056 B2
(45) Date of Patent: Jun. 11, 2013

(54) BUILT-IN ANTENNA FOR PORTABLE TERMINAL

(75) Inventors: Joon-Ho Byun, Yongin-si (KR); Seong-Tae Jeong, Yongin-si (KR); Bum-Jin Cho, Hwaseong-si (KR); Soon-Ho Hwang, Gangnam-gu (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 259 days.

(21) Appl. No.: 12/963,063

(22) Filed: Dec. 8, 2010

(65) Prior Publication Data

US 2011/0187608 A1 Aug. 4, 2011

(30) Foreign Application Priority Data

Jan. 29, 2010 (KR) ..... 10-2010-0008372

(51) Int. Cl.
*H01Q 1/24* (2006.01)

(52) U.S. Cl.
USPC ..... 343/702; 343/700 MS

(58) Field of Classification Search
USPC ..... 343/700 MS, 702, 846
See application file for complete search history.

(56) References Cited

U.S. PATENT DOCUMENTS

| | | | | |
|---|---|---|---|---|
| 7,218,282 | B2 * | 5/2007 | Humpfer et al. | 343/700 MS |
| 7,825,863 | B2 * | 11/2010 | Martiskainen et al. | 343/702 |
| 8,081,122 | B2 * | 12/2011 | Kearney et al. | 343/700 MS |
| 2007/0146217 | A1 | 6/2007 | Stricker | |
| 2008/0079635 | A1 * | 4/2008 | Rowell | 343/700 MS |
| 2009/0295653 | A1 | 12/2009 | Komura | |

FOREIGN PATENT DOCUMENTS

| | | | |
|---|---|---|---|
| EP | 1 505 689 | A1 | 2/2005 |
| JP | 2002-151930 | A | 5/2002 |
| KP | 10-2008-0111362 | A | 12/2008 |

* cited by examiner

*Primary Examiner* — Tan Ho
(74) *Attorney, Agent, or Firm* — Jefferson IP Law, LLP

(57) ABSTRACT

A built-in antenna for a portable terminal is provided. The built-in antenna includes a substrate including a ground region and a non-ground region, an antenna radiator formed in a pattern with a preset shape within the non-ground region of the substrate, at least one sub-radiation pattern formed in a pattern type while including a preset spacing distance from the antenna radiator, and a conductive plate with a preset height, electrically connecting the sub-radiation pattern to the antenna radiator and/or the sub-radiation pattern.

18 Claims, 5 Drawing Sheets

BUILT-IN ANTENNA FOR PORTABLE TERMINAL

PRIORITY

This application claims the benefit under 35 U.S.C. §119 (a) of a Korean patent application filed in the Korean Intellectual Property Office on Jan. 29, 2010 and assigned Serial No. 10-2010-0008372, the entire disclosure of which is hereby incorporated by reference.

BACKGROUND OF THE INVENTION

1. Field of the Invention

The present invention relates to a built-in antenna for a portable terminal. More particularly, the present invention relates to a built-in antenna for a portable terminal, which enhances a radiation characteristic of a Printed circuit board Embedded Antenna (PEA) and reduces a Specific Absorption Rate (SAR) of electromagnetic waves.

2. Description of the Related Art

Since portable wireless terminals (hereinafter, referred to as potable terminals) were initially developed, increased services and functions have been developed. Services, which had supported conventional voice communications, are currently extended from transmitting short messages and pictures to Internet and broadcasting services. In addition to a simple communication function, functions such as a camera function and an MPEG Audio Layer 3 (MP3) function have been provided to terminals, and display of the terminals have changed from black-and-white display to high-definition color Liquid Crystal Display (LCD) display. While the number of communicable services in one band was two or three, six or more services are currently used in one band. The sizes of current terminals have been developed to be lighter and slimmer than those of initial terminals. This is because elements built in the terminals are designed to be very small in size and very high in performance. However, there is no exception to terminal antennas. While initial terminal antennas secured only single or two service bands as external type antennas, current terminal antennas secure at least four to six service bands or more as built-in type antennas. Further, the size of the current terminal antennas has considerably decreased. In view of antenna performance closely related to the physical size of antennas the antenna conditions have increasingly deteriorated.

Several methods for designing an antenna have been proposed to decrease the physical space of an antenna in a portable terminal in order to secure various high-performance service bands and to reduce manufacturing cost. One representative antenna is a Printed circuit board Embedded Antenna (PEA) that forms a radiation pattern on a substrate surface. The PEA is very important in reducing manufacturing costs of terminals because it's manufacturing costs are low as compared with a carrier-type antenna according to the related art. In addition, the PEA can be implemented smaller than an antenna using a dielectric or magneto dielectric material (hereinafter, referred to as a chip antenna). This is because the PEA does not require 3D cubic space like the carrier-type antenna and the chip antenna according to the related art, but requires only a 2D planar space.

Meanwhile, to develop a high-performance, small antenna in the limited antenna space of a terminal requires considerable costs. In a case where it is impossible to mount the carrier-type antenna, a specific material (i.e., dielectric or magneto dielectric material) should be used. However, the cost of the specific material is expensive. When considering the number of terminal models annually developed by terminal manufacturers and released in the market, the time, cost and manpower necessary for designing antennas and ensuring performance of the antennas are beyond expectation. Whenever a terminal is developed, it is urgently required to reduce the time, cost and manpower necessary for designing an antenna in order to reduce the entire cost and time necessary for manufacturing terminals. Accordingly, profits can be improved in terminal manufacturers, and customers can obtain great economic benefit and convenience.

A carrier type antenna frequently used in designing a multi-band antenna according to the related art requires a certain space, and the shape of the carrier-type antenna also depends on the shape of a terminal case. Therefore, a carrier should be individually designed whenever a terminal is designed. Furthermore, antennas should be manually assembled one by one which results in increased time and cost required to develop antennas. If it is difficult to ensure the performance of the carrier due to the very small antenna space of the terminal, a chip antenna using a dielectric or magneto dielectric material is used. In this case, the cost of the material for the chip antenna is further increased, and increased time is still required to assemble the antenna. As terminals become smaller and slimmer, it becomes increasingly difficult to mount not only the carrier-type antenna but also the chip antenna in a given antenna space. Accordingly, as the PEA has been developed, many problems have been solved in view of the antenna size or material cost, but other problems still exist.

In the case of the carrier-type antenna built in a terminal according to the related art, it is very difficult to apply the carrier-type antenna to a slim terminal. This is because the height of an antenna should be secured to a certain extent and mounting the carrier-type antenna in the slim terminal is impossible due to the height of the carrier-type antenna itself. In a case where the chip antenna is used, the height of the chip-type antenna is smaller than that of the carrier-type antenna, but the height of the chip antenna is also secured to a certain extent. Further, the cost of the chip antenna is about two times greater than that of the carrier-type antenna, and hence it is difficult to apply the chip antenna to the slim terminal.

Therefore, the cost of materials for the antenna should be reduced to decrease the cost of the entire terminal. When a terminal is assembled, the carrier-type antenna or the chip antenna is individually assembled which is inefficient and thus results in increased labor cost.

The PEA has solved many problems of the carrier-type antenna or the chip antenna. However, when the PEA is mounted in a terminal, the position of the PEA is close to a user's head. Therefore, the PEA may have a bad influence on a human body. Further, it is difficult to manufacture a PEA having a service bandwidth that is usable for a multi-band service.

SUMMARY OF THE INVENTION

An aspect of the present invention is to address at least the above-mentioned problems and/or disadvantages and to provide at least the advantages below. Accordingly, an aspect of the present invention is to provide a built-in antenna for a portable terminal, which can implement radiation efficiency.

Another aspect of the present invention is to provide a built-in antenna for a portable terminal, in which a conductive plate including a preset height and length is mounted on a Printed circuit board Embedded Antenna (PEA), thereby increasing the PEA bandwidth.

Still another aspect of the present invention is to provide a built-in antenna of a portable terminal, which can decrease a Specific Absorption Rate (SAR) of electromagnetic waves by disposing the built-in antenna at a position distant from a user's head during conversation on the portable terminal.

Yet another aspect of the present invention is to provide a built-in antenna of a portable terminal, which implements excellent radiation efficiency and assembling property, and reduce manufacturing cost.

According to an aspect of the present invention, a built-in antenna for a portable terminal is provided. The antenna includes, a substrate including a ground region and a non-ground region, an antenna radiator formed in a pattern with a preset shape within the non-ground region of the substrate, at least one sub-radiation pattern formed in a pattern type while including a preset spacing distance from the antenna radiator, and a conductive plate with a preset height, electrically connecting the sub-radiation pattern to the antenna radiator and/or the sub-radiation pattern.

According to an aspect of the present invention, a portable terminal with a built-in antenna is provided. The portable terminal includes a substrate including a ground region and a non-ground region; an antenna radiator formed in a pattern with a preset shape within the non-ground region of the substrate, at least one sub-radiation pattern formed in a pattern type while including a preset spacing distance from the antenna radiator, and a conductive plate with a preset height, electrically connecting the sub-radiation pattern to at least one of the antenna radiator and the sub-radiation pattern.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

In descriptions of exemplary embodiments of the present invention, a bar-type portable terminal will be illustrated and described. However, it will be apparent that the exemplary embodiments of the present invention may be applied to various open/close type terminals to which a built-in antenna is applied, such as a folder-type terminal and a slide-type terminal.

Figure 1:
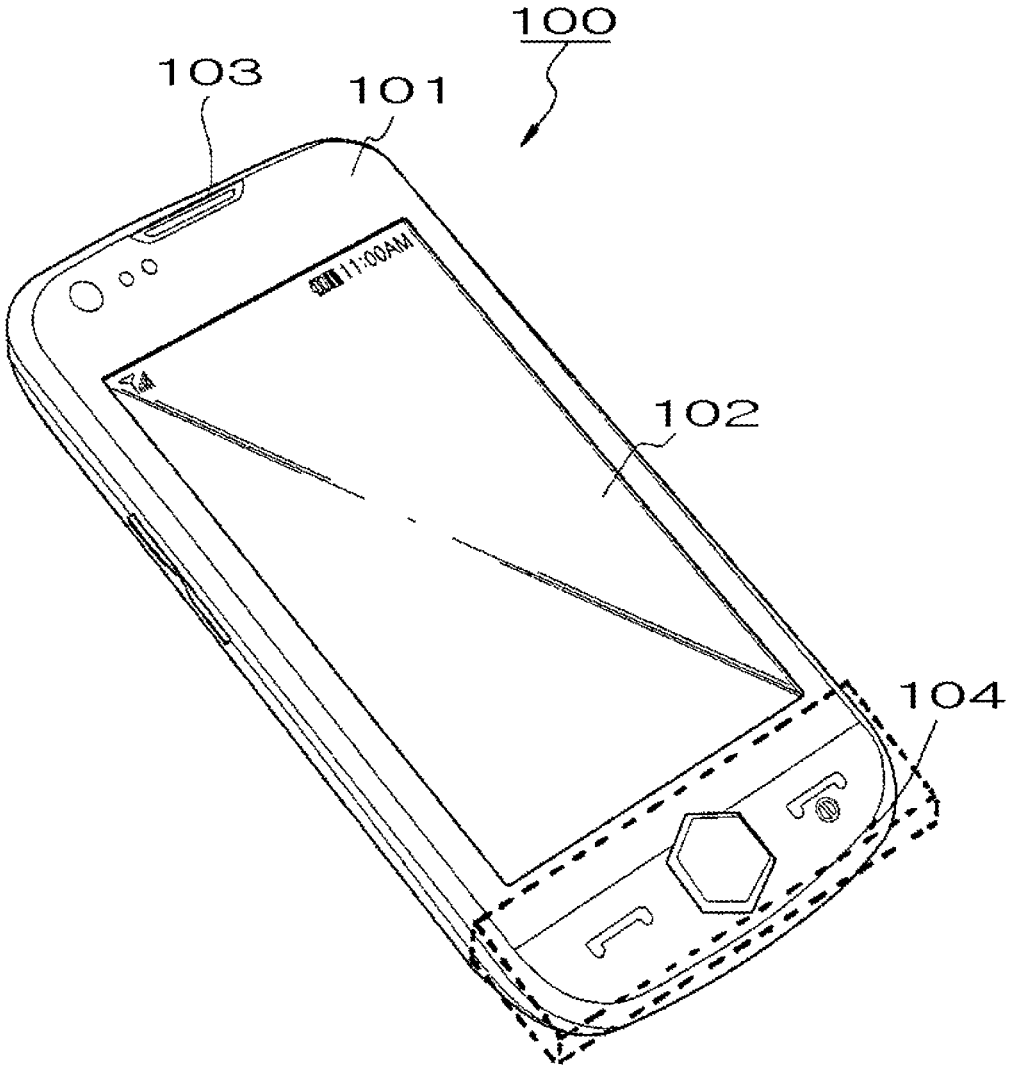
FIG. 1 is a perspective view of a portable terminal to which a built-in antenna is applied according to an exemplary embodiment of the present invention.

FIG. 1 is a perspective view of a portable terminal to which a built-in antenna is applied according to an exemplary embodiment of the present invention.

Referring to FIG. 1, the portable terminal 100 is a bar-type terminal, and a display 102 is mounted to a front face 101 of the portable terminal 100. A speaker 103 is mounted to an upper portion of the display 102, and a microphone 104 is mounted to a lower portion of the display 102. A touch screen may be applied to the display 102, and a key button using a mechanical metal dome sheet may be excluded.

A built-in antenna 1 (illustrated in FIG. 2) according to an exemplary embodiment of the present invention is applied to the portable terminal 100. The built-in antenna may be applied to a bottom portion (i.e., the portion indicated by dotted line in FIG. 1) of the portable terminal 100. This position of the built-in antenna applied to the portable terminal 100 may provide a maximum spacing distance from a user's head during conversation on a portable terminal, and a smallest change in radiation characteristic. Alternatively, the built-in antenna according to an exemplary embodiment of the present invention may be applied to a rear face of a Printed Circuit Board (PCB) built in the portable terminal 100. Thus, an antenna radiator may be disposed at a position most distant from a human body, thereby minimizing the Specific Absorption Rate (SAR) of electromagnetic waves, which has influence on the human body.

Figure 2:
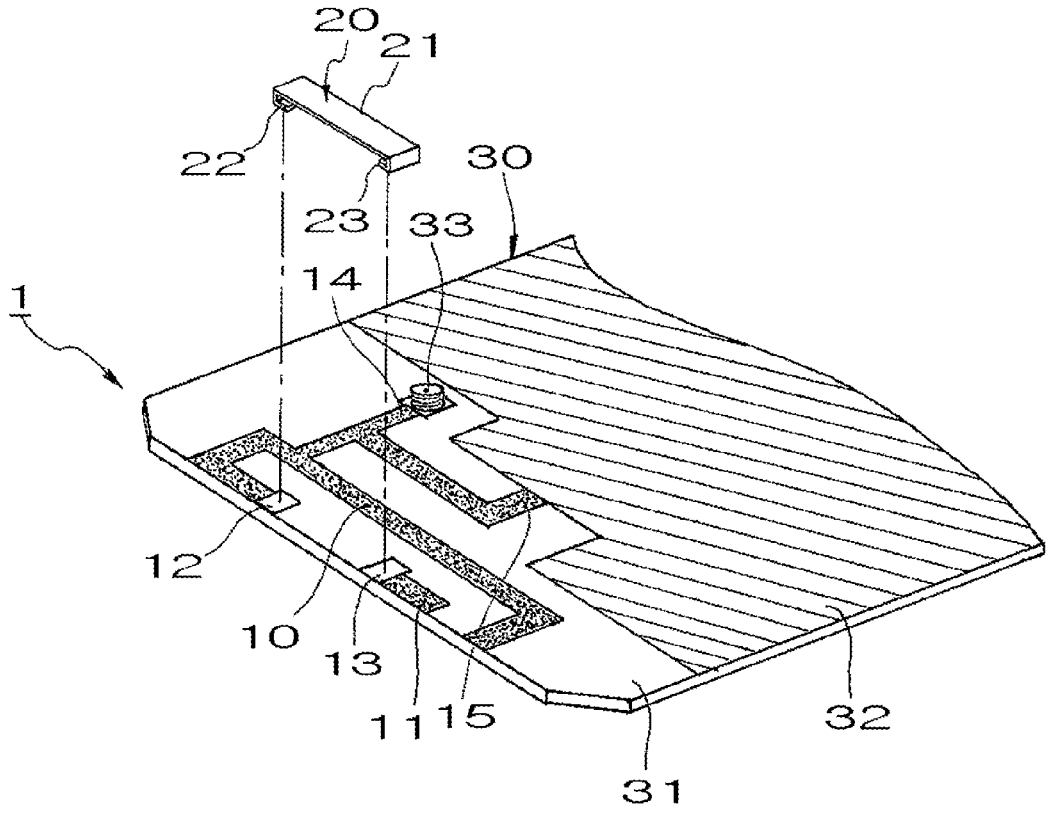
FIG. 2 is a perspective view of a built-in antenna to which a conductive plate is applied according to an exemplary embodiment of the present invention.

FIG. 2 is a perspective view of a built-in antenna to which a conductive plate is applied according to an exemplary embodiment of the present invention.

Figure 3:
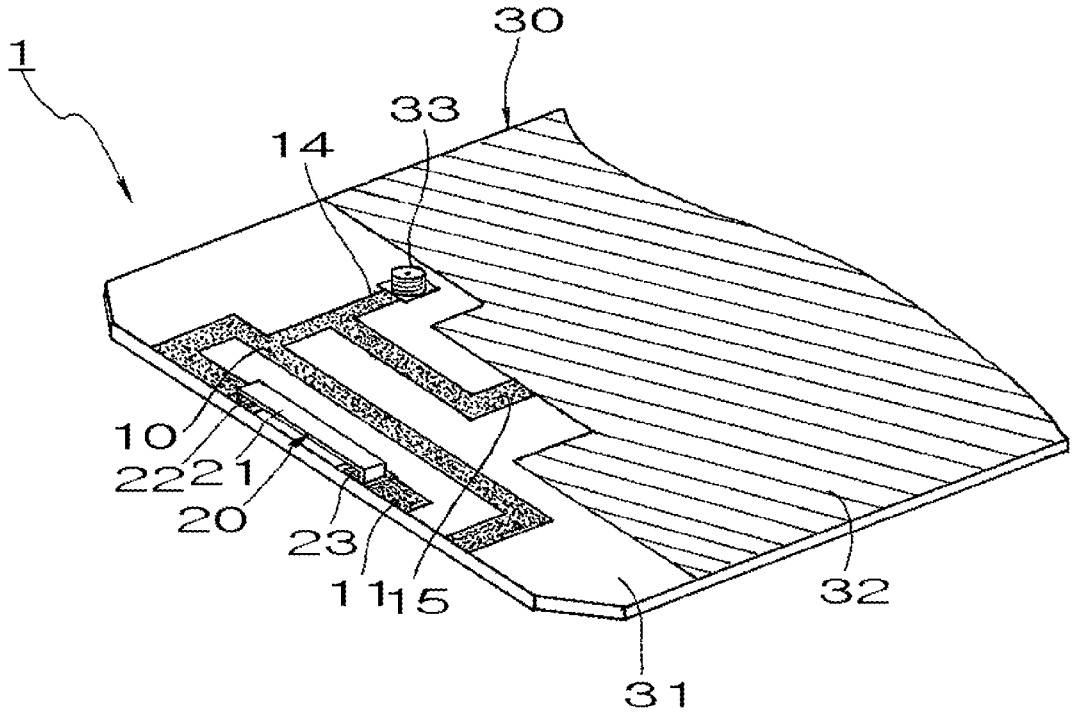
FIG. 3 is an assembled perspective view of the built-in antenna to which the conductive plate is applied according to an exemplary embodiment of the present invention.

FIG. 3 is an assembled perspective view of the built-in antenna to which the conductive plate is applied according to an exemplary embodiment of the present invention.

Referring to FIGS. 2 and 3, the built-in antenna 1 is applied based on a PCB Embedded Antenna (PEA) according to the related art. If the PEA is two-dimensionally implemented on a PCB, the built-in antenna 1 according to an exemplary embodiment of the present invention is different from the PEA according to the related art in that a metal plate having height that is additionally applied to the PEA according to the related art, thereby three-dimensionally implementing the built-in antenna 1.

Thus, the built-in antenna 1 is applied to a rear face, which corresponds to a rear direction of the portable terminal, of a PCB 30 (hereinafter, referred to as a substrate). The substrate 30 is divided into a ground region 32 and a region 31 in which an antenna radiation pattern is formed. A conductor that constitutes the ground region 32 is not applied to the region 31 which the antenna radiation pattern is formed.

The antenna radiation pattern may be variously implemented according to the use band and performance of a corresponding terminal. When the substrate 30 is formed, the antenna radiation pattern may be formed as a pattern together with the substrate 30. The antenna radiation pattern includes a main radiation pattern 10 and a sub-radiation pattern 11 having a physical spacing distance from the main radiation pattern 10. The main radiation pattern 10 is not electrically connected to the sub-radiation pattern 11. The main radiation pattern 10 includes a feeding line 14 and a ground line 15. The feeding line 14 may be electrically connected to a Radio Frequency (RF) connector 33 mounted on the substrate 30, and the ground line 15 may be electrically connected to the ground region 32 of the substrate 30. When the substrate 30 is initially formed, the feeding line 14 and the ground line 15 may be formed as a pattern together with the substrate 30.

The main radiation pattern 10 and the sub-radiation pattern 11 are electrically connected by a conductive plate 20 having a preset length, width and height. Connection pads 12 and 13 may be provided to ends of the main radiation pattern 10 and the sub-radiation pattern 11, respectively. The conductive plate 20 includes a connection platform 21 having a preset length and bent surfaces 22 and 23 respectively formed at both ends of the connection platform 21. Thus, the conductive plate 20 is mounted as a Surface-Mount Device (SMD) on the substrate 30 so that the bent surfaces 22 and 23 come in contact with the connection pads 12 and 13, respectively. The conductive plate 20 may be fixed to the substrate 30 through processes including soldering, bonding and the like. The length, height and width of the conductive plate 20 may be varied according to the use band of a corresponding terminal, the radiation characteristic of the antenna, and the like.

Although not illustrated, the antenna radiation pattern may be divided into a plurality of sub-radiation patterns. In this case, each of the sub-radiation patterns may be electrically connected to a main radiation pattern, or a plurality of conductive plates having various shapes may be applied for the purpose of electrical connection between the sub-radiation patterns. The conductive plate may be connected in the vicinity of the feeding line in the radiation pattern on the substrate, or may be connected in the middle of the radiation pattern. Alternatively, the conductive plate may be connected to an end of the radiation pattern.

Although not illustrated, the main radiation pattern and the sub-radiation pattern, formed in a pattern type on the substrate, may be formed on a front or rear face of the substrate or on both the front and rear faces of the substrate. However, the conductive plate operated at a resonance frequency may be formed on the rear face of the substrate to be disposed at a position most distant from a user's head during conversation on a mobile telephone. As a result, the SAR of electromagnetic waves may be reduced.

Figure 4A:
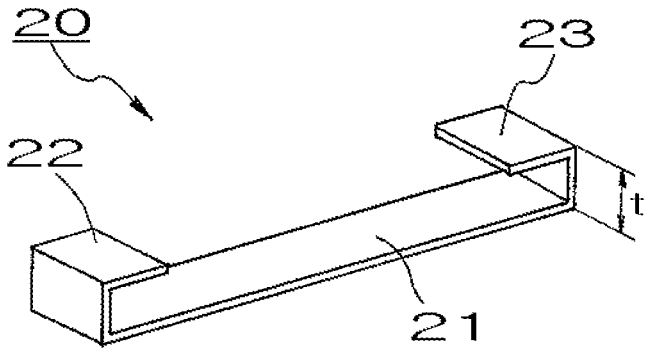
FIGS. 4A and 4B are perspective views of a conductive plate according to an exemplary embodiment of the present invention.
Figure 4B:
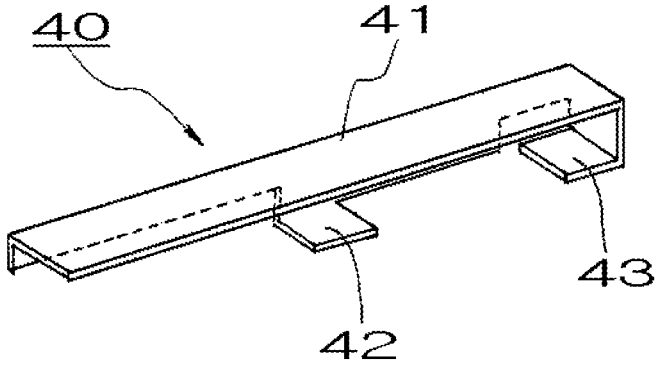

FIGS. 4A and 4B are perspective views of a conductive plate according to an exemplary embodiment of the present invention.

Referring to FIGS. 4A and 4B, the conductive plate 20 may be variously modified. In FIG. 4A, a connection platform 21 having a preset length is formed, and bent surfaces 22 and 23 are formed by bending the connection platform 21 twice. The bent surfaces 22 and 23 may come in contact with connection pads of a main radiation pattern and a sub-radiation pattern, respectively.

In this case, the height t of the conductive plate 20 may not exceed 5 mm.

In a conductive plate 40 illustrated in FIG. 4B, one end of a connection platform 41 has a bent surface 43 as illustrated in FIG. 4A, and another bent surface 42 is formed to be extended from the center of the connection platform 41. That is, the conductive plate 40 may be variously modified.

Table 1 shows an efficiency in the Global System for Mobile communications (GSM) and Digital Cellular Service (DCS) bands of a PEA according to the related art and the built-in antenna (PEA+) to which the conductive plate is applied according to an exemplary embodiment of the present invention. In table 1, TRP denotes transmit power and TIS denotes transmit receiver sensitivity.

TABLE 1

| | PEA | | PEA+ | |
|---|---|---|---|---|
| Band | GSM | DCS | GSM | DCS |
| Efficiency(%) | 31 | 38 | 42 | 45 |
| TRP(dBm) | 25.3 | 25.1 | 27.6 | 25.7 |
| TIS(dBm) | −104.4 | −104.4 | −104.8 | −106.1 |

It can be seen that the efficiency of the built-in antenna according to an exemplary embodiment of the present invention is slightly superior in GSM and DCS bands to that of the PEA according to the related art.

Figure 5:
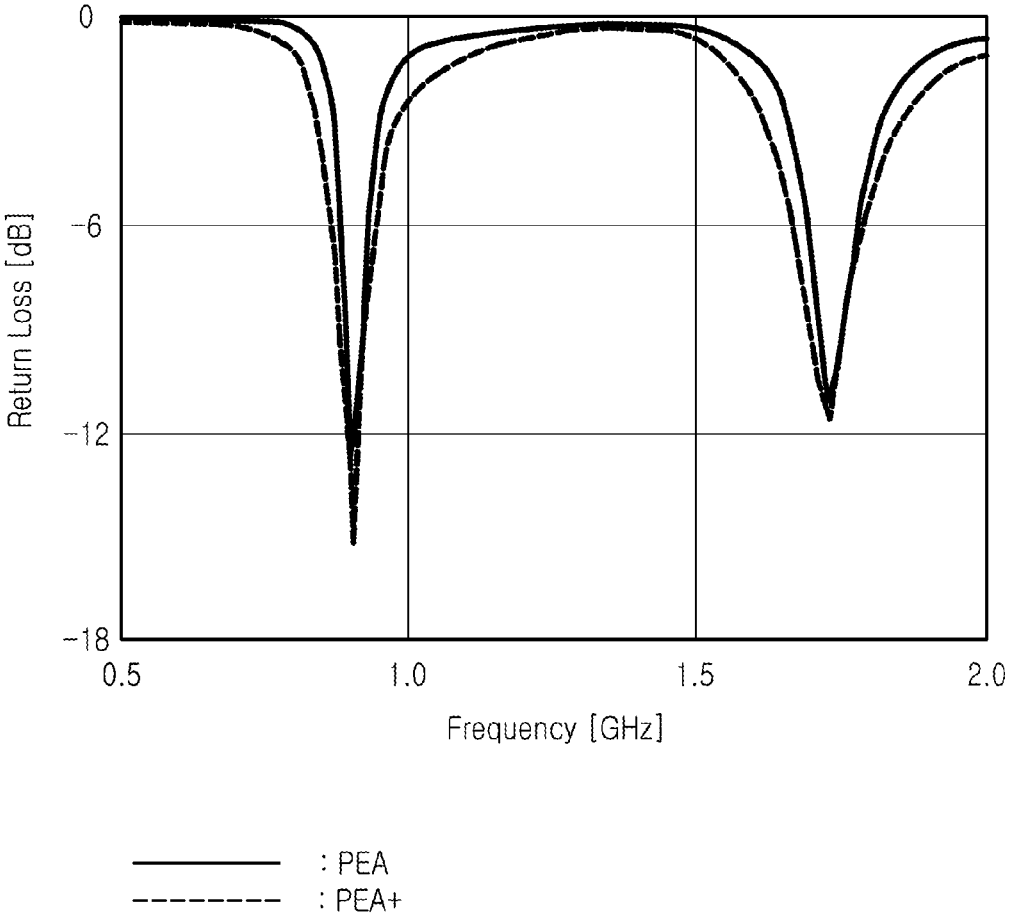
FIG. 5 is a graph comparing a Printed circuit board Embedded Antenna (PEA) performance to which a conductive plate is applied with a PEA performance to which the conductive plate is not applied according to an exemplary embodiment of the present invention.

FIG. 5 is a graph comparing a PEA performance to which a conductive plate is applied with a PEA performance to which the conductive plate is not applied. That is, a return loss performance of the built-in antenna (PEA+) to which the conductive plate is applied according to an exemplary embodiment of the present invention is compared with that of the built-in antenna (PEA) to which the conductive plate is not applied.

Referring to FIG. 5, bandwidths of the PEA are 45 MHz and 86 MHz in the GSM and DCS bands, respectively, and the bandwidths of the PEA+ are improved by 31 MHz and 39 MHz in the GSM and DCS bands, respectively.

In the built-in antenna according to an exemplary embodiment of the present invention, a conductive plate having a preset length, width and height is applied to the PEA according to the related art, so that the bandwidth of the built-in antenna may be increased, thereby obtaining excellent radiation efficiency. Since the built-in antenna may be disposed at a position most distant from a user's head, it is possible to decrease the SAR of electromagnetic waves, to enhance an assembling property of the built-in antenna and to reduce manufacturing cost.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A built-in antenna for a portable terminal, the built-in antenna comprising:

a substrate including a ground region and a non-ground region;

an antenna radiator formed in a pattern with a preset shape within the non-ground region of the substrate;

at least one sub-radiation pattern formed in a pattern type while including a preset spacing distance from the antenna radiator; and a conductive plate with a preset height, electrically connecting the at least one sub-radiation pattern to the antenna radiator, wherein the at least one sub-radiation pattern is spaced apart from the ground region and is electrically connected to the ground region only via the conductive plate and the antenna radiator.

2. The built-in antenna of claim 1, wherein the antenna radiator and the at least one sub-radiation pattern are formed on at least one of a front face and a rear face of the substrate.

3. The built-in antenna of claim 1, wherein the antenna radiator comprises a feeding line electrically connected to a Radio Frequency (RF) connector mounted on the substrate, and a ground line electrically connected to the ground region of the substrate.

4. The built-in antenna of claim 3, wherein the RF connector is mounted in the non-ground region.

5. The built-in antenna of claim 3, wherein the conductive plate is at least one of disposed near the feeding line of the antenna radiator, in the middle of the antenna radiator, and disposed in an end of the antenna radiator.

6. The built-in antenna of claim 1, wherein the conductive plate comprises a connection platform including a preset length and a preset width, and bent surfaces respectively bent twice in the same direction from both ends of the connection platform to include preset heights and bonding surfaces.

7. The built-in antenna of claim 6, wherein the respective bent surfaces of the conductive plate are mounted as a Surface-Mount Device (SMD) to connection pads formed at the antenna radiator and the at least one sub-radiation pattern through at least one of soldering and bonding.

8. The built-in antenna of claim 1, wherein the conductive plate is mounted on a rear face of the substrate to be disposed at a position most distant from a human head during conversation on the portable terminal.

9. The built-in antenna of claim 1, wherein the conductive plate comprises a height that is about 5 mm or less.

10. A portable terminal with a built-in antenna, the portable terminal comprising:

a substrate including a ground region and a non-ground region;

an antenna radiator formed in a pattern with a preset shape within the non-ground region of the substrate;

at least one sub-radiation pattern formed in a pattern type while including a preset spacing distance from the antenna radiator; and a conductive plate with a preset height, electrically connecting the at least one sub-radiation pattern to the antenna radiator, wherein the at least one sub-radiation pattern is spaced apart from the ground region and is electrically connected to the ground region only via the conductive plate and the antenna radiator.

11. The portable terminal of claim 10, wherein the antenna radiator and the sub-radiation pattern are formed on at least one of a front face and a rear face of the substrate.

12. The portable terminal of claim 10, wherein the antenna radiator comprises a feeding line electrically connected to a Radio Frequency (RF) connector mounted on the substrate, and a ground line electrically connected to the ground region of the substrate.

13. The portable terminal of claim 12, wherein the RF connector is mounted in the non-ground region.

14. The portable terminal of claim 12, wherein the conductive plate comprises a connection platform including a preset length and a preset width, and bent surfaces respectively bent twice in the same direction from both ends of the connection platform to have preset heights and bonding surfaces.

15. The portable terminal of claim 14, wherein the respective bent surfaces of the conductive plate are mounted as a Surface-Mount Device (SMD) to connection pads formed at the antenna radiator and the at least one sub-radiation pattern through at least one of soldering and bonding.

16. The portable terminal of claim 12, wherein the conductive plate is at least one of disposed near the feeding line of the antenna radiator, in the middle of the antenna radiator, and disposed in an end of the antenna radiator.

17. The portable terminal of claim 10, wherein the conductive plate is mounted on a rear face of the substrate to be disposed at a position most distant from a human head during conversation on the portable terminal.

18. The portable terminal of claim 10, wherein the conductive plate comprises a height that is about 5 mm or less.

* * * * *